US007909204B2

(12) United States Patent
Antal, Sr.

(10) Patent No.: US 7,909,204 B2
(45) Date of Patent: Mar. 22, 2011

(54) RESEALING OVERCAP FOR A CONTAINER

(75) Inventor: Keith E. Antal, Sr., Valatie, NY (US)

(73) Assignee: Sonoco Development, Inc., Hartsville, SC (US)

( * ) Notice: Subject to any disclaimer, the term of this patent is extended or adjusted under 35 U.S.C. 154(b) by 417 days.

(21) Appl. No.: 12/041,131

(22) Filed: Mar. 3, 2008

(65) Prior Publication Data

US 2009/0218351 A1 Sep. 3, 2009

(51) Int. Cl.
*B65D 51/18* (2006.01)

(52) U.S. Cl. ..... 220/785; 200/254.1

(58) Field of Classification Search ..... 220/367.1, 220/366.1, 258.2, 258.3, 258.1, 256.1, 254.1, 220/803, 802, 801, 798, 797, 796, 212, 789, 220/787, FOR. 206, FOR. 204, FOR. 203; 215/224, 307, 228, 345, 344, 343, 341, 352, 215/354, 364, 355, 216, 212, 211, 316, 200; D9/439, 463, 435, 454, 445; 277/514, 552, 277/549; 222/153.1; *B65D 51/16, 47/32*
See application file for complete search history.

(56) References Cited

U.S. PATENT DOCUMENTS

| | | | | |
|---|---|---|---|---|
| 1,761,603 A | | 6/1930 | Wainwright | |
| 3,021,976 A | | 2/1962 | Tracy | 220/6 |
| 3,061,139 A | | 10/1962 | Edwards | |
| 3,080,993 A | | 3/1963 | Livingstone | |
| 3,178,051 A | | 4/1965 | Edwards | 220/60 |
| 3,244,308 A | | 4/1966 | Esposito, Jr. | |
| 3,307,602 A | | 3/1967 | Bolter | 150/5 |
| 3,380,610 A | | 4/1968 | Krieps | |
| 3,401,819 A | | 9/1968 | Salamone | 220/48 |
| 3,419,181 A | * | 12/1968 | Stec | 220/258.2 |
| 3,434,620 A | * | 3/1969 | Laurizio | 220/258.2 |
| 3,454,186 A | | 7/1969 | Melone | 429/175 |
| 3,519,163 A | | 7/1970 | Bardell | |
| 3,559,843 A | | 2/1971 | Kern | |
| 3,572,540 A | | 3/1971 | LaCroce | 220/42 |
| 3,613,938 A | | 10/1971 | Westcott | |
| 3,624,789 A | | 11/1971 | Peyser | 220/97 B |
| 3,643,830 A | | 2/1972 | Kinney | 220/203.09 |
| 3,679,089 A | | 7/1972 | Sweet et al. | |

(Continued)

FOREIGN PATENT DOCUMENTS

DE 23 54 106 10/1973

(Continued)

OTHER PUBLICATIONS

Sonoco Models 401 and 603 overcaps (2004).

(Continued)

*Primary Examiner* — Anthony Stashick
*Assistant Examiner* — Robert J Hicks
(74) *Attorney, Agent, or Firm* — Flaster/Greenberg P.C.

(57) ABSTRACT

An overcap is provided for fitting over a top end of a container of the type having a top end closure including an inner rim defining an opening for access to the inside of the container. The overcap includes a body portion having an outer peripheral flange for attachment to the top end closure. The overcap further includes a downwardly depending flange adapted to engage the inner rim of the top end closure with a friction fit. The downwardly depending flange includes a vent that is active during engagement of the flange with the inner rim, prior to forming the friction fit between the flange and the rim.

16 Claims, 4 Drawing Sheets

U.S. PATENT DOCUMENTS

| | | | | |
|---|---|---|---|---|
| 3,749,277 | A * | 7/1973 | Kinney | 220/785 |
| 3,804,287 | A | 4/1974 | Balocca et al. | 220/27 |
| 4,044,941 | A | 8/1977 | Knudsen | 229/43 |
| 4,154,360 | A | 5/1979 | Smith | 220/258 |
| 4,310,102 | A | 1/1982 | Walter | 220/288 |
| 4,387,819 | A * | 6/1983 | Corsette | 215/273 |
| 4,426,014 | A | 1/1984 | Coltman, Jr. | |
| 4,453,646 | A * | 6/1984 | Harrild | 220/258.5 |
| 4,466,553 | A | 8/1984 | Zenger | 220/461 |
| 4,573,605 | A | 3/1986 | Udell | 220/304 |
| 4,765,499 | A * | 8/1988 | von Reis et al. | 215/261 |
| 4,932,554 | A | 6/1990 | Smith et al. | 220/319 |
| 4,989,740 | A | 2/1991 | Vercillo | 215/252 |
| 5,054,642 | A | 10/1991 | Yoshida | 220/276 |
| 5,125,522 | A * | 6/1992 | Pezzoli et al. | 215/250 |
| 5,261,551 | A | 11/1993 | Watt | 220/256 |
| 5,353,943 | A | 10/1994 | Hayward | 220/276 |
| 5,395,005 | A * | 3/1995 | Yoshida | 220/359.2 |
| 5,575,383 | A | 11/1996 | Seeley | 206/217 |
| 5,743,427 | A | 4/1998 | Monus | 220/791 |
| 5,775,531 | A | 7/1998 | Lowry | 220/212.5 |
| 5,785,196 | A | 7/1998 | Montgomery | |
| 5,842,593 | A | 12/1998 | von Holdt | 220/212.5 |
| 5,855,288 | A | 1/1999 | Dallas, Jr. | |
| 5,865,335 | A | 2/1999 | Farrell et al. | |
| 5,899,352 | A | 5/1999 | Guarda et al. | 220/254 |
| 6,196,451 | B1 | 3/2001 | Helms | 229/125.13 |
| 6,220,471 | B1 | 4/2001 | Lowry | 220/258 |
| 6,401,986 | B1 | 6/2002 | Randall | 222/212 |
| 6,450,358 | B1 | 9/2002 | Berro | 220/258.2 |
| 6,588,618 | B1 | 7/2003 | Davis | 220/254.7 |
| 6,799,692 | B2 | 10/2004 | Teixeira Alvares et al. | 220/254.1 |
| 7,074,443 | B2 | 7/2006 | Thomas et al. | |
| 7,090,089 | B2 | 8/2006 | Lown et al. | |
| 7,165,306 | B2 | 1/2007 | Bezek et al. | 29/453 |
| 7,169,418 | B2 | 1/2007 | Dalton et al. | |
| 7,169,419 | B2 | 1/2007 | Dalton et al. | |
| 7,311,218 | B2 | 12/2007 | Varadarajan | 220/257.1 |
| 7,337,916 | B2 | 3/2008 | Clougherty | |
| 2003/0010787 | A1* | 1/2003 | Dalton et al. | 220/912 |
| 2004/0045964 | A1 | 3/2004 | Alvares et al. | 220/254.1 |
| 2004/0096552 | A1* | 5/2004 | Thomas et al. | 426/118 |
| 2004/0256348 | A1 | 12/2004 | Stevens et al. | |
| 2005/0236465 | A1 | 10/2005 | Stevens | |
| 2006/0091140 | A1* | 5/2006 | Perry et al. | 220/258.2 |
| 2009/0114650 | A1 | 5/2009 | Houston, Jr. et al. | |
| 2009/0232947 | A1 | 9/2009 | Buisson et al. | |

FOREIGN PATENT DOCUMENTS

| | | |
|---|---|---|
| EP | 0 248 744 | 12/1987 |

OTHER PUBLICATIONS

International Search Report for PCT/US09/33920.

International Preliminary Report on Patentability for PCT/US09/33920.

* cited by examiner

RESEALING OVERCAP FOR A CONTAINER

FIELD OF THE INVENTION

The present invention relates to an overcap for sealing the top end of a container.

BACKGROUND OF THE INVENTION

Easy-open containers have been used for a variety of products, including powdered materials, such as food products, cleaning products, etc. Easy-open containers are often constructed of a composite cylindrical body portion having end closures for closing and sealing the container. In some examples, the top end closure comprises an end ring, fixed to the container body, and an inside circular peripheral rim in the form of an inwardly directed flange, which may include a downwardly curved bead. The inner rim defines a central opening of desired size for access to the interior of the container. A removable membrane patch covers the central opening and may be attached to the inwardly extending flange. To open the container, the membrane patch is detached from the container, providing access to the product therein.

Easy-open containers often include overcaps, fitting over the container top end portion and top end closure. The overcap serves many functions including, but not limited to, protecting the top of the container from damage before and after removal of the membrane, keeping unwanted items from getting into the container, keeping the product within the container from spilling out, helping to improve stacking of the container, and increasing the life of the product after opening.

In addition, when moisture or oxygen sensitive products are packaged in the container, there is a need for sealing the container, after removal of the membrane, to prevent undesirable exposure of the contents of the container.

A resealing overcap for a container is shown in commonly assigned U.S. Pat. No. 6,220,471 to Lowry, which is herein incorporated by reference. A generally circular overcap is fit over the top end of a cylindrical container and top end closure. The overcap includes a resealing ring projecting downwardly from the body of the overcap. The resealing ring may be moved into engagement with the inner rim of the top end of the container to seal the contents of the container.

SUMMARY OF THE INVENTION

The present invention relates to an overcap for a container of the type having a container body defined by a side wall, and opposing top and bottom end portions. A top end closure is attached to the top end portion of the container body for closing the container and retaining product therein. The top end closure includes a peripheral outer rim secured to the container sidewall, an inwardly positioned flange and an inner rim defining an access opening into the interior of the container. The resealing overcap includes a body portion releaseably fitting over the periphery of the top end closure. The overcap further includes a sealing portion for releasably engaging the inner rim of the access opening. The sealing portion includes a downwardly depending flange having a peripheral dimension approximately equal to the dimension of the inner rim and an engagement bead for engaging the inner rim with a friction fit. In addition, one or more vents are formed on the engagement bead. The vents are active during engagement of the bead with the inner rim, prior to forming the friction fit with the inner rim.

BRIEF DESCRIPTION OF THE DRAWINGS

For purposes of illustrating the invention, there is shown in the accompanying drawings a form which is presently preferred; it being understood, however, that the invention is not limited to the precise arrangements shown and instrumentalities shown.

DETAILED DESCRIPTION OF DRAWINGS

Figure 1:
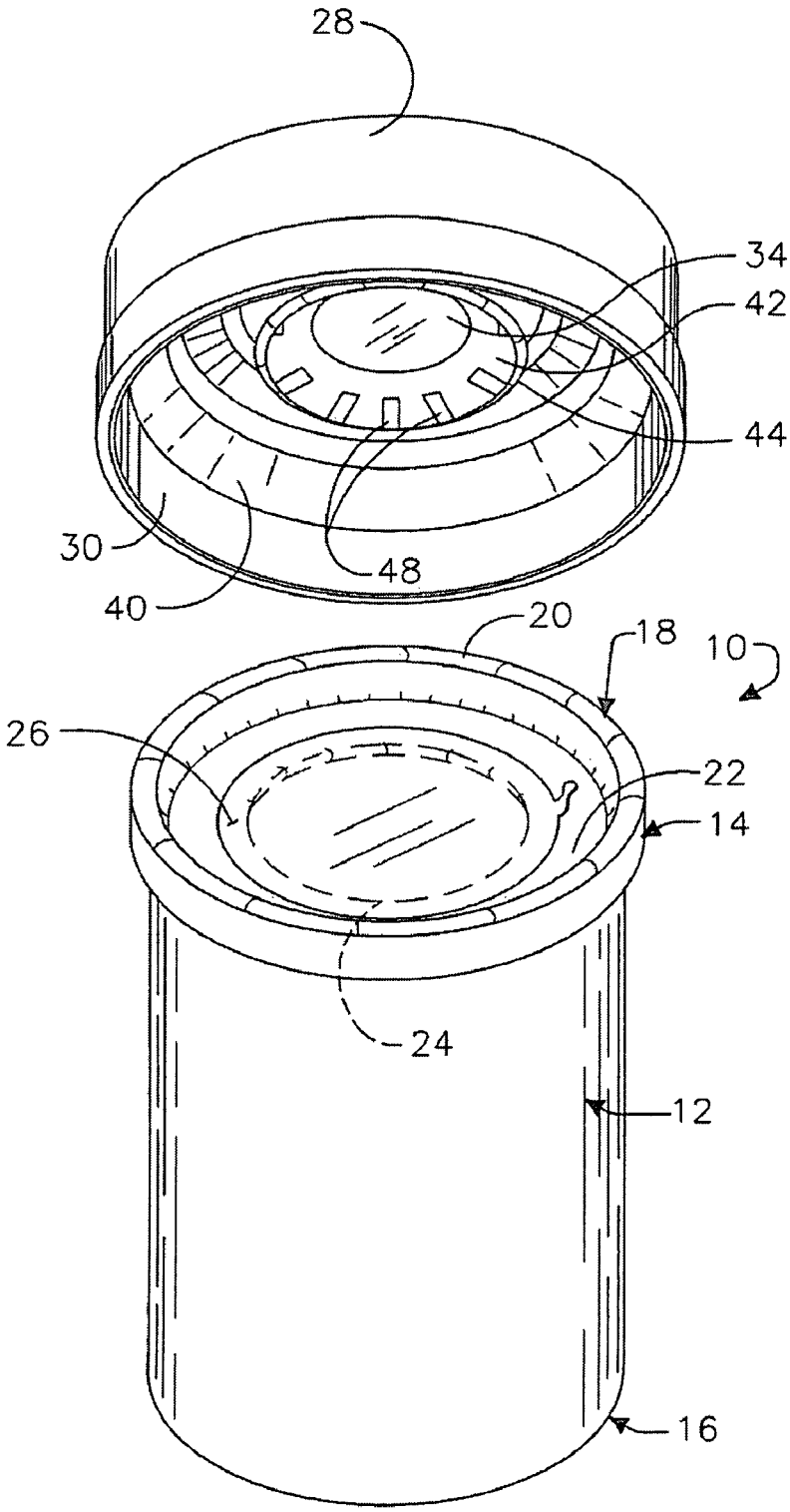
FIG. 1 is a perspective view of an easy-open container having the overcap of the present invention shown in an exploded position.

Referring now to the drawings, where like numerals identify like elements there is shown in FIG. 1 a container, generally indicated by the numeral 10. The container 10 is adapted to be filled with a product (not shown), such as powdered or granulated food products, cleaning products, etc. The container 10 may be of any desired configuration and may be constructed of any desired material including composites, plastic, metal, etc. It is preferred that the container be constructed of composite materials, including paper layers, of the type which are understood by those within the art. It is also preferred that the container have a generally cylindrical shape, although other shapes and profiles are contemplated.

As illustrated, the container 10 comprises a generally cylindrical container body 12 defining top and bottom opposite end portions 14, 16. The container 10 includes top end closure 18 attached to the top end portion 14. A bottom end closure may also be included on the bottom end portion 16 of the container 10. The top end closure 18 is used to close and seal the container 10 with product therein. The top end closure 18 is contemplated to be attached to the container body 12 in any known manner. The bottom end closure may be integrally formed with the container 10 or attached to the bottom end portion 16 of the container body 12.

Figure 2:
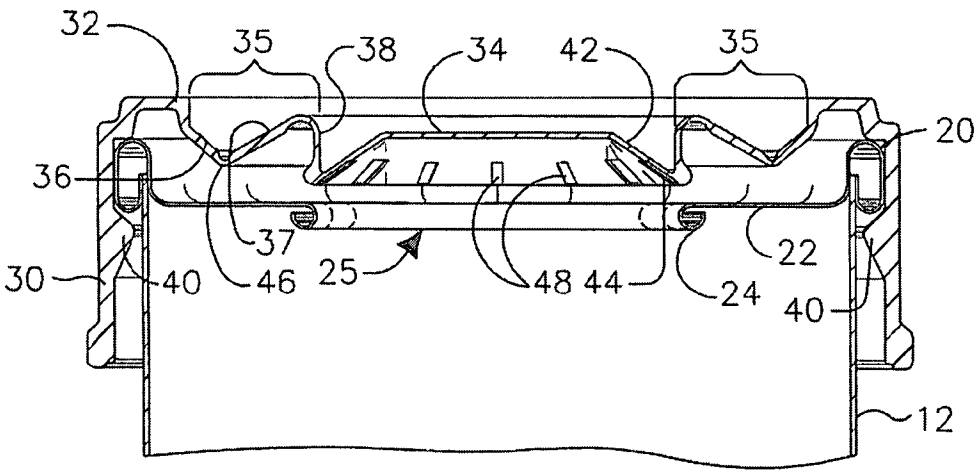
FIG. 2 is a cross sectional view of the top portion of the container of FIG. 1 with the overcap of the present invention thereon.
Figure 3:
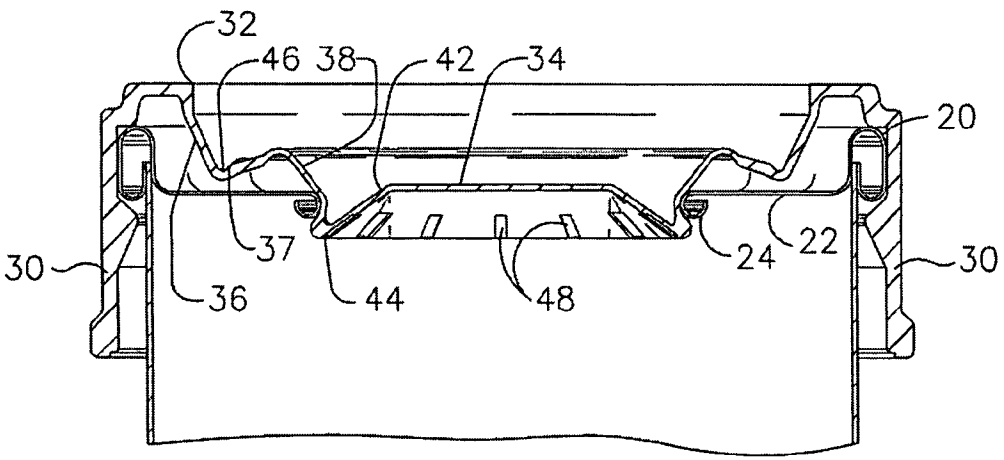
FIG. 3 is a cross sectional view of the top portion of the container and overcap of the present invention with the overcap in sealed position.
Figure 4:
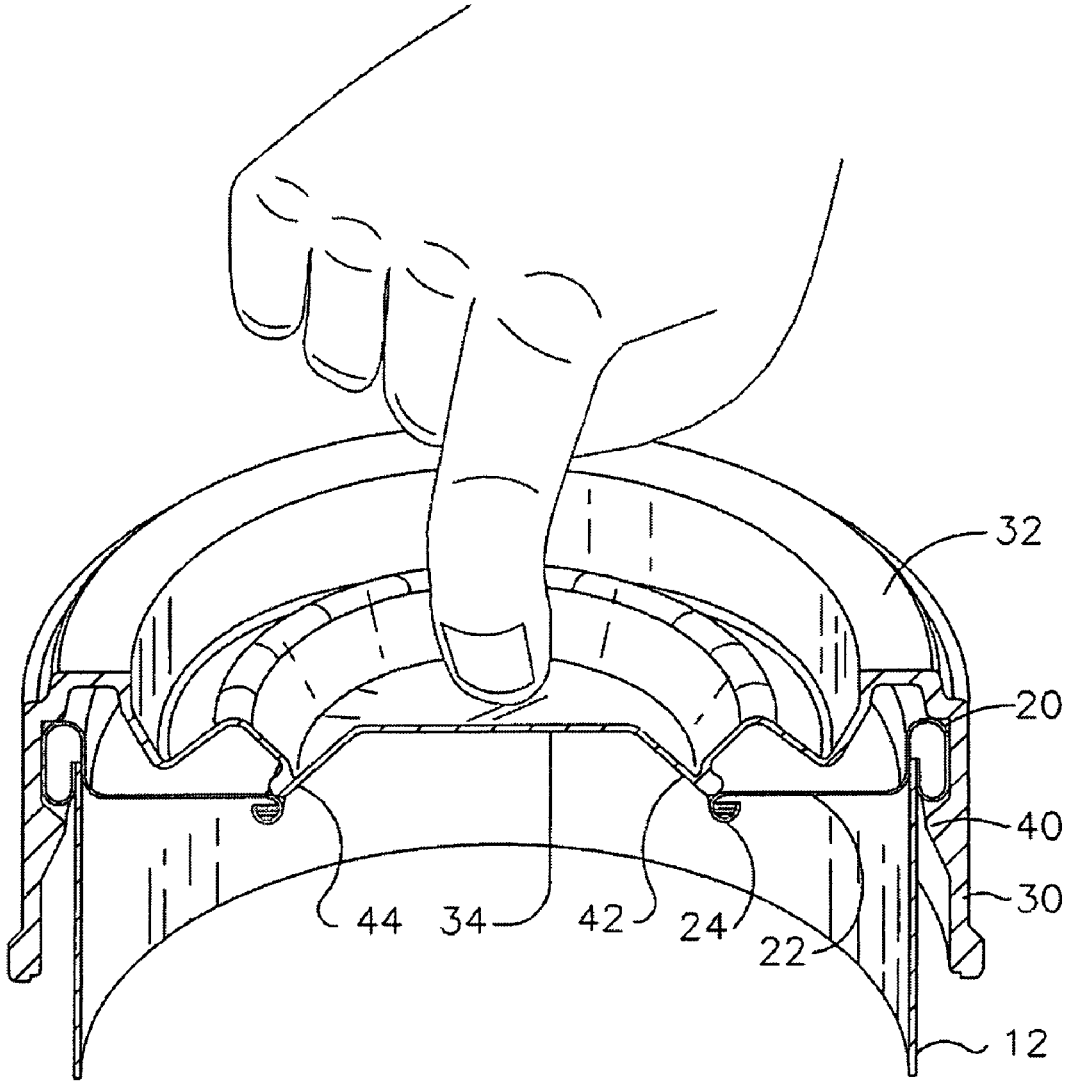
FIG. 4 is a perspective view with a partial cross section with the overcap being moved from a first position towards the sealed position.

As more particularly shown in FIGS. 2-4, the top end closure 18 comprises an end ring 20 secured to the container body top end portion 14. A circular flange 22 extends inwardly from the end ring 20. As illustrated, the flange 22 defines an inner rim 24 in the form of a downwardly and inwardly curved inner rim 24. The central opening 25 is sized to allow access to the interior of the container 10. The top end closure 18 further includes an easy-open membrane patch 26 (FIG. 1) of sufficient size to cover the central opening 25. The patch 26 is attached to the flange 22, preferably by an adhesive. The bond is preferably sufficient to resist the internal forces created within the container, while being relatively weak so as to allow for removal of the patch 26 from the top end closure 18 of the container 10. The bond or attachment between the patch 26 and the flange 22 may be formed by any suitable means, including heat sealing, adhesive, etc. Preferably, the bond is formed by providing the patch 26 and/or the flange 22 with a polypropylene heat seal layer.

A resealing overcap 28 is provided over the top end portion 14 and releasably engages the top end closure 18. The overcap 28 comprises a circular body portion 32 and an annular outer flange 30 that is attached to and extending downwardly from the outer periphery of the body 32. A snap fit or friction fit is provided between the end ring 20 and outer flange 30 of the overcap 28.

The outer flange 30 of the overcap 28 projects downwardly from the body 32 and has an internal dimension adapted to engage the end ring 20 of the top end closure 18 with a friction fit. A snap ridge 40 projects inwardly from the internal surface of the flange 30 and fits underneath the ring 20 when the overcap 28 is positioned on the top end closure 18. The ridge 40 is positioned on the flange 30, such that the end ring 20 fits between the ridge 40 and the body 32 of the overcap 28. The overcap 28 is flexible, allowing the outer flange 30 to move away from the end ring 20 and the ridge 40 to clear the top end closure 18 when it is desired to remove the overcap 28 from the container 10.

The overcap 28 further includes a generally planar central portion 34 connected to the body portion 32 by a flexing section 25. The flexing section 35 permits the central portion 34 to move downwardly relative to the outer flange 30 so that it may engage the inner rim 24 of the top end closure 18. The flexing section 35 includes an angled flange 42 that depends generally downwardly from a central portion 34. An engagement bead or ridge 44 is formed at the end of the flange 42 and projects radially outward of the flange 42. The peripheral dimension of the flange 42 is contemplated to be approximately equal to the dimension of the inner rim 24 that defines the central opening 25. The engagement bead 44 extends radially outwardly from the flange 42 and is sized to engage the inner rim 24 with a fiction fit, when the central portion 34 is moved toward the opening 25.

In FIG. 2, the alignment of the bead 44 and the flange 42 with respect to the inner rim 24 and the central opening 25 is shown prior to the secondary sealing of the central opening 25. The overcap 28 is positioned on the top end closure with the ridge 40 engaging the underside of the end ring 20. As illustrated in FIG. 4, a downward force is applied to the central portion 34 to move the flange 42 toward the central opening 25, such that the engagement bead 44 contacts the inner rim 24 above the central opening, as illustrated in FIG. 3. The friction fit of the bead 44 with the inner rim 24 creates a secondary seal of the container 10. The friction fit is released upon removal of the overcap 28 from the top end closure 18.

The flexing section 35 of the overcap 28 is formed by a series of angled rings 36, 37, 38, which connect the angled flange 42 and central portion 34 with the outer flange 30 of the overcap 28. The joints between the rings 36, 37, 38 may have a reduced wall thickness, so as to form a living hinge. The radially innermost flange 38 extends from the engagement bead 44 upwardly to a rounded curve that connects to the central ring 37. As illustrated in FIG. 2, the central ring 37 includes a thinned area 46 at its connection with the radially outermost ring 36. The alternating angle of the rings 36, 37, 38 and the thinned joints assist in the movement of the central portion 34 relative to the outer periphery of the body 32 and the outer flange 30. As illustrated in FIG. 3, once the bead 44 engages the underside of the inside rim 24, the flexible rings 36, 37, 38 assume a different angle as compared to their normal rest position, illustrated in FIG. 2.

Figure 5:
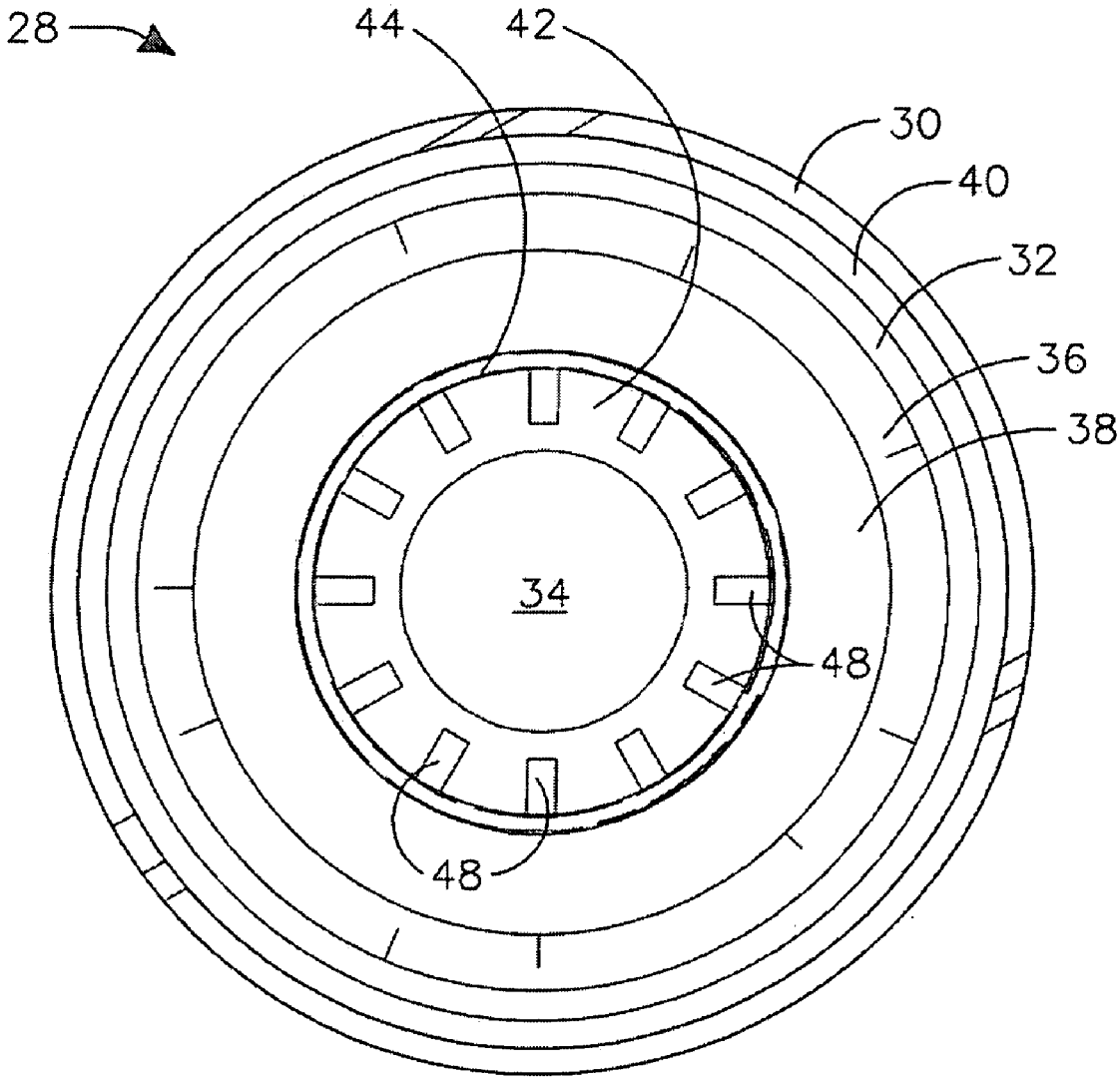
FIG. 5 is a bottom plan view of the overcap of the present invention.

As the central portion 34 of the overcap 28 is moved toward the access opening 25, there is an increase in pressure within the reservoir portion of the container 10. This is due to the movement of the overcap body downwardly and the sealing engagement of the bead 44 with the inner rim 24. As illustrated in FIG. 5, a plurality of vents 48 is provided on the flange 42 and the bead 44. The vents 48 start on the underside of the flange 42 and extend to the underside of the bead 44. The vents 48 are contemplated to engage the flange 22 of the top end closure 18 upon initial contact of the bead 44 with the inner rim 24, as illustrated in FIG. 4. During the downward movement of the central portion 34 and flange 42, and the pressure increase within the container 10, air attempts to move outwardly through the central opening 25. The internal pressure increase within the container reservoir tends to resist the engagement of the bead 44 with the rim 24 as well as muffles the sound of the friction fit between the bead 44 and the rim 24. By providing vents 48, the air more readily moves around the bead 44 and the rim 24 and results in a more audible "snap" sound, as the bead is moved through the central opening 25. Thus, the user is provided with an audible indication of a sealing engagement.

The vents 48 serve to increase the sound of engagement of the overcap 28 with the inner rim and to reduce the force needed to engage the bead 44 with the inner rim 24 of the top end closure 18. The vents 48 may be in the form of slits or grooves and are preferably formed on the lower end of the bead 44. The material adjacent the vents 48 engages the inner rim 24. The vents 48 preferably start on the inside surface of the flange 42 and extend around to the underside of the bead 44. Preferably, the vents 48 do not extend around the bead 44 past the transition between its bottom surface and upper surface. As shown in FIG. 3, the vents 48 do not engage the inner rim 24 when the relatively upper or top surface of the bead 44 is sealed within the opening 25. Looking at the left side of the cross section of the central portion 34 and angled flange 42, the vents 48 preferably start around the 3 o'clock position on the inside surface of the bead 44 and extend around to the bottom edge or 6 o'clock position. The vents 48 may extend past the 6 o'clock portion, but preferably do not extend beyond the 9 o'clock position on the left or radially outward edge of the bead 44. Again looking at FIG. 3, on the night side of the cross section, the vents 48 preferably start at the 9 o'clock position, extend around the bottom or 6 o'clock position and continue upwardly toward the 3 o'clock position. The vents will normally, fall within this range, although variations are possible without falling outside the scope of the contemplated invention.

The number of vents may vary as desired, depending on the level of engagement between the central portion of the overcap and the inner rim of the top end closure. In addition, the vents are contemplated to have significant depth so as to create a bridge upon engagement between the bead and the inner rim. When the central portion of the overcap engages the rim of the central opening, air in the container at least partially escapes through the vents allowing the central portion to freely move through the central opening. The air movement allows the bead on the overcap to quickly enter the central opening and to create a "snap" or similar audible sound upon engagement with the rim.

In the drawings and specification, there has been set forth a preferred embodiment of this invention and, although specific terms are employed, these terms are used in a generic and descriptive sense only and not for purposes of limitation. The scope of the invention is set forth in the following claims.

What is claimed is:

1. In a container comprising a container body defined by a side wall, a top end portion and a bottom end portion opposite the top end portion, a top end closure is attached to the top end portion for closing and sealing the container with product therein, the top end closure including an end ring having an peripheral outer rim secured to said container body top end portion and an inner rim defining an access opening into the interior of the container, a resealing overcap comprising:

a body portion constructed for releasably fitting over the peripheral outer rim of the end ring closure;

a sealing portion for covering the access opening in the container, the sealing portion having a downwardly depending flange, the flange having a peripheral dimension approximately equal to the dimension of the inner rim of the access opening, an engagement bead on the depending flange for engaging and sealing with the inner rim with a friction fit, and a vent formed on the engagement bead, the vent being active during engagement of the bead with the inner rim prior to the sealing of the bead and the inner rim.

2. In a container as set forth in claim 1, wherein the overcap further comprises a plurality of vents formed on the engagement bead.

3. In a container as set forth in claim 1, wherein the overcap further comprises a flexible ring connecting the body portion to the sealing portion, the flexible ring providing a resilient movement of the sealing portion during downward engagement of the engagement bead with the inner rim.

4. In a container as set forth in claim 1, wherein the resealing overcap is formed from an injection molded plastic.

5. In a container as set forth in claim 1, wherein the resealing overcap further comprises an engagement ridge formed on an inside surface of the body portion for releasably engaging outer rim of the top end closure.

6. An overcap for a container having a top end portion forming an outer rim and an inner rim, the inner rim defining a central opening into the interior of the container, the overcap comprising:

a flexible body portion for releasably fitting over the outer rim of the container and for covering the central opening in the container;

a downwardly extending flange having a peripheral dimension approximately equal to the dimension of the central opening;

an engagement bead on the flange for engaging the inner rim of the central opening and for sealing with the flange within the central opening by a friction fit; and a vent formed on the depending flange adjacent the engagement bead, the vent active during initial engagement of the depending flange with the inner rim of the central opening prior to the sealing engagement of the bead on the flange with the inner rim of the opening.

7. An overcap as set forth in claim 6, wherein the overcap further comprises a plurality of vents formed in the depending flange.

8. An overcap as set forth in claim 6, further comprising a flexible ring within the body portion for resilient movement of the flange into engagement with the inner rim of the container.

9. An overcap as set forth in claim 8, further comprising an engagement ridge positioned on a peripheral skirt formed on the body portion, radially outward of the flexible ring, the engagement ridge formed for engaging the outer rim for releasably fitting the body over the open top end of the container.

10. An overcap as set forth in claim 6, wherein the body portion, the flange and the engagement bead are integrally formed of an injection molded plastic.

11. An overcap for a container having a top end portion forming an outer rim and an inner rim, the inner rim defining a central opening into the interior of the container, the overcap comprising:

a flexible body portion for releasably fitting over the outer rim of the container and for covering the central opening into the container, the body portion having a top surface, a bottom surface and a peripheral rim;

a flange projecting from the bottom surface of the body, the flange having a peripheral dimension approximately equal to the dimension of the central opening;

an engagement bead formed on the flange for engaging the rim of the central opening and for sealing the flange within the central opening by a friction fit; and a vent formed on the projected end of the depending flange on the relative underside of the engagement bead, the vent being active during initial engagement of the bead with the rim of the central opening and prior to the sealing engagement of the bead with the underside of the rim of the opening.

12. An overcap as set forth in claim 11, wherein the overcap further comprises a plurality of vents formed on the bead of the depending flange.

13. An overcap as set forth in claim 11, further comprising a flexible ring formed inwardly of the peripheral skirt, the ring permitting resilient movement of the body portion adjacent the flange for engagement of the flange with the inner rim of the container.

14. An overcap as set forth in claim 13, further comprising an engagement ridge positioned on a peripheral skirt formed on the body portion, radially outward of the flexible ring, the engagement ridge formed for engaging the outer rim for releasably fitting the body over the open top end of the container.

15. An overcap as set forth in claim 11, further comprising a flexible ring within the body portion for permitting resilient movement of the flange into engagement with the inner rim of the container.

16. An overcap as set forth in claim 11, wherein the body portion, the flange and the engagement bead are integrally formed of an injection molded plastic.

* * * * *